US008757254B2

(12) United States Patent
Villreal et al.

(10) Patent No.: US 8,757,254 B2
(45) Date of Patent: Jun. 24, 2014

(54) ADJUSTMENT OF MUD CIRCULATION WHEN EVALUATING A FORMATION

(75) Inventors: Steven G. Villreal, Houston, TX (US); Julian J. Pop, Houston, TX (US); Vladimir Vaynshteyn, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/857,699

(22) Filed: Aug. 17, 2010

(65) Prior Publication Data

US 2011/0198076 A1 Aug. 18, 2011

Related U.S. Application Data

(60) Provisional application No. 61/234,789, filed on Aug. 18, 2009.

(51) Int. Cl.
*E21B 47/06* (2012.01)
*E21B 47/00* (2012.01)
*E21B 49/08* (2006.01)

(52) U.S. Cl.
USPC ..... 166/250.01; 166/264; 175/25; 175/59

(58) Field of Classification Search
USPC ..... 166/230, 250.1, 250.08, 250.17, 264, 166/250.01; 175/42, 50, 59, 60, 25, 58
See application file for complete search history.

(56) References Cited

U.S. PATENT DOCUMENTS 5,555,945 A 9/1996 Schultz et al.
5,799,733 A 9/1998 Ringgenberg et al.
6,068,394 A 5/2000 Dublin, Jr.
6,148,912 A 11/2000 Ward
6,176,323 B1 * 1/2001 Weirich et al. ..... 175/40
6,237,404 B1 * 5/2001 Crary et al. ..... 73/152.03
6,427,530 B1 * 8/2002 Krueger et al. ..... 73/152.46
6,427,785 B2 8/2002 Ward
6,641,434 B2 11/2003 Boyle et al.
6,672,409 B1 * 1/2004 Dock et al. ..... 175/107
6,814,142 B2 11/2004 Paulk et al.
6,866,306 B2 3/2005 Boyle et al.
6,932,167 B2 8/2005 Proett et al.

(Continued)

FOREIGN PATENT DOCUMENTS

WO 2008100156 8/2008
WO 2009042494 4/2009

OTHER PUBLICATIONS

Dong, C. et al., New Downhole Fluid Analyzer Tool for Improved Reservoir Characterization, SPE 108566, Aberdeen, Scotland, Sep. 4-7, 2007.

(Continued)

*Primary Examiner* — Blake Michener
(74) *Attorney, Agent, or Firm* — Kimberly Ballew; Mark Shelley, II

(57) ABSTRACT

A method for controlling drilling fluid rate in a wellbore is disclosed. A drill string is disposed into the well and connected to a formation testing or sampling tool. Drilling fluid is circulated at a first rate through the drill string. Data related to the wellbore, a formation about the wellbore or the formation sampling tool is transmitted to a processor. Upon analysis of the data, the drilling fluid circulation rate is changed to a second rate that is different from the first rate.

7 Claims, 9 Drawing Sheets

(56) References Cited

U.S. PATENT DOCUMENTS

| | | | | |
|---|---|---|---|---|
| 7,093,674 | B2 | 8/2006 | Paluch et al. | |
| 7,096,961 | B2 | 8/2006 | Clark et al. | |
| 7,204,309 | B2 | 4/2007 | Segura et al. | |
| 7,216,533 | B2 | 5/2007 | McGregor et al. | |
| 7,243,537 | B2 | 7/2007 | Proett et al. | |
| 7,251,566 | B2 | 7/2007 | Wu et al. | |
| 2003/0168258 | A1* | 9/2003 | Koederitz | 175/38 |
| 2004/0000433 | A1* | 1/2004 | Hill et al. | 175/59 |
| 2004/0065477 | A1* | 4/2004 | Paulk et al. | 175/50 |
| 2004/0108138 | A1* | 6/2004 | Cooper et al. | 175/26 |
| 2004/0256152 | A1* | 12/2004 | Dashevskiy et al. | 175/25 |
| 2005/0194134 | A1* | 9/2005 | McGregor et al. | 166/264 |
| 2005/0257960 | A1* | 11/2005 | McGregor et al. | 175/24 |
| 2005/0284659 | A1* | 12/2005 | Hall et al. | 175/27 |
| 2006/0037781 | A1* | 2/2006 | Leuchtenberg | 175/25 |
| 2006/0124352 | A1* | 6/2006 | Krueger et al. | 175/25 |
| 2006/0235617 | A1 | 10/2006 | Sinha et al. | |
| 2007/0029112 | A1 | 2/2007 | Li et al. | |
| 2007/0030162 | A1 | 2/2007 | Okada et al. | |
| 2007/0079962 | A1* | 4/2007 | Zazovsky et al. | 166/264 |
| 2007/0137293 | A1 | 6/2007 | Pop et al. | |
| 2007/0137896 | A1* | 6/2007 | Villareal et al. | 175/59 |
| 2007/0151762 | A1* | 7/2007 | Reitsma | 175/40 |
| 2007/0181341 | A1 | 8/2007 | Segura et al. | |
| 2008/0115574 | A1* | 5/2008 | Meek | 73/152.03 |
| 2008/0156486 | A1 | 7/2008 | Ciglenec et al. | |
| 2009/0166085 | A1 | 7/2009 | Ciglenec et al. | |
| 2009/0173493 | A1 | 7/2009 | Hutin et al. | |
| 2010/0108384 | A1* | 5/2010 | Byreddy et al. | 175/27 |
| 2011/0266056 | A1* | 11/2011 | Pop et al. | 175/50 |

OTHER PUBLICATIONS

Hammond, P.S. et al., Correcting Supercharging in Formation-Pressure Measurements Made While Drilling, SPE 95710, Dallas, Texas, Oct. 9-12, 2005.

* cited by examiner

ADJUSTMENT OF MUD CIRCULATION WHEN EVALUATING A FORMATION

CROSS-REFERENCE TO RELATED APPLICATIONS

This application claims priority from U.S. Patent Application No. 61/234,789, entitled "Adjustment of Mud Circulation When Evaluating a Formation," filed on Aug. 18, 2009, and incorporated by reference in its entirety.

BACKGROUND OF THE DISCLOSURE

It is conventional to convey formation testing and/or formation sampling tools into a wellbore penetrating a subterranean formation. Formation testing and/or formation sampling tools are usually configured to establish a fluid communication with the formation and to measure characteristics of the fluid contained in the formations pores.

Some formation testing and/or formation sampling tools may be lowered into the wellbore via tubing or a drill string having a mud column in a bore therethrough, and may utilize a mud pulse telemetry system to provide measurements during the testing/sampling operation. Mud pulse telemetry uses acoustic waves in the drilling fluid to transmit data from the tools to the surface, or vice versa. Descriptions of such formation testing and/or formation sampling tools may be found, for example, in U.S. Pat. Nos. 5,555,945, 5,799,733, 6,148,912, 7,093,674, 7,243,537 and in PCT Patent Application Pub. No. WO 2008/100156, the disclosures of which are incorporated herein by reference.

There have been various attempts over the years to develop telemetry systems for providing improved communication between a well site located at the Earth's surface and one or more downhole tools that are faster, have higher data rates, and do not require the presence and/or the circulation of a particular type of drilling fluid. For example, acoustic telemetry has been proposed, which transmits acoustic waves through the drill string. Another example is electromagnetic telemetry through the earth. The placement of wires in drill pipes for carrying signals (sometimes referred to as Wired Drill Pipe telemetry) has also been proposed. These telemetry systems may enable improvements in operating a formation testing and/or formation sampling tool conveyed via tubing or drill string.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
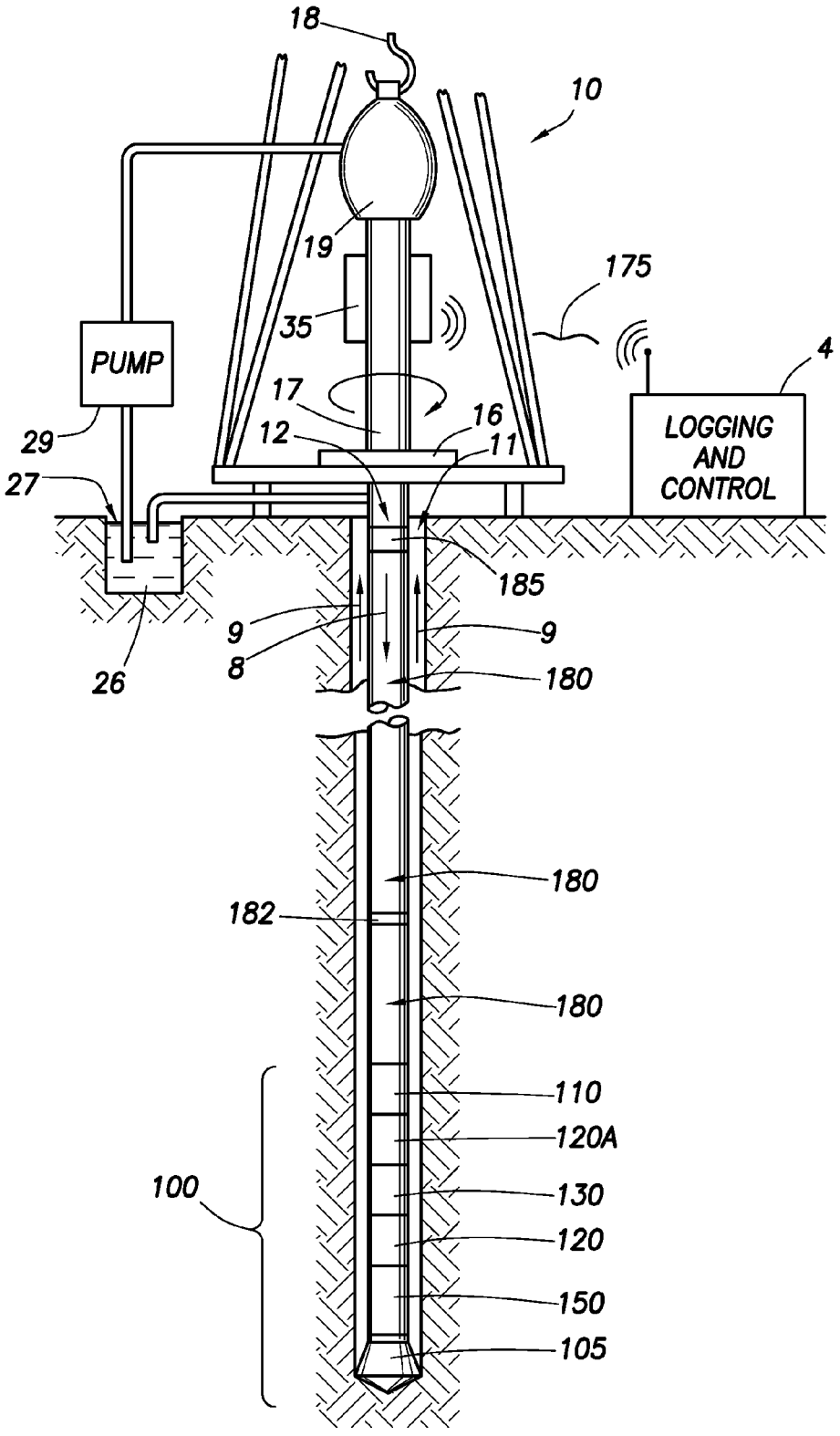
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Telemetry systems may be used for providing two-way communication (i.e., downlink and uplink) between a wellsite located at or near the Earth's surface and one or more downhole measurement tools. For example, mud pulse telemetry is typically achieved via modulating the circulating drilling fluid (sometimes referred to as mud pulsing). A mud pulse telemetry system typically comprises surface pressure sensors and actuators (such as variable rate pumps) and downhole pressure sensors and actuators (such as a siren) for sending acoustic signals between the one or more downhole tools and the Earth's surface. These signals are usually encoded, for example compressed, and decoded by surface and downhole controllers. The low telemetry rates provided by mud pulse telemetry may limit the amount of downhole measurement data available at the Earth's surface for making real-time decisions. In addition, the low telemetry rates may limit the speed at which commands may be sent from the Earth's surface to the one or more downhole tools.

While performing formation testing and/or sampling, mud pulse telemetry may have additional disadvantages. For example, communication between the well site and the formation testing and/or formation sampling tool via mud pulse telemetry may not be available during pumps-off periods, (i.e., periods during which the mud circulation is interrupted), and more generally when mud circulation rates are below approximately 300 gallons per minutes (gpm), thus preventing the monitoring and adjustment of the testing and/or sampling operation by a controller or operator located at the Earth's surface. Further, drilling fluid circulation and/or mud pulsing occurring when using mud pulse telemetry may add pressure noise to the formation pressure measurements. As a result, this noise may mask or shift the formation response and reduce the accuracy, resolution and value of the measurements. Still further, mud pulsing may negatively affect the electrical power produced from a downhole turbine and a downhole alternator. The downhole turbine or alternator may be used by the formation testing and/or formation sampling tool for performing formation testing and/or sampling. Yet still further, communication between the well site and the formation testing and/or formation sampling tool may be compromised when varying the mud circulation rate for formation testing purposes and/or may interfere with the mud circulation rate desired for formation testing purposes. Yet still further, mud cake lining the wellbore and providing hydraulic seal between the wellbore and the formation may be eroded by mud circulation and/or mud pulsing, thus causing mud filtrate to migrate into the formation, and reducing the quality and value of the samples drawn into the tool.

The present disclosure describes methods and apparatus for operating a formation testing and/or formation sampling tool conveyed via drill string. Please note that the term "drill string" is used herein in the broad sense to include single shouldered drill pipe, double shouldered drill pipe, wired drill pipe, coiled tubing, casing, and any other form of tubing known to those having ordinary skill in the art. The methods and apparatus herein may be implemented using a telemetry system that does not rely exclusively on mud circulation, such as wired drill pipe ("WDP") telemetry, electromagnetic telemetry, acoustic telemetry and/or any combination thereof. The telemetry system may be used to communicate between the well site and a bottom hole assembly ("BHA") having a formation testing or sampling tool. The WDP telemetry system may permit decoupling mud circulation from communication between the well site and the formation testing or sampling tool. Therefore, mud circulation may be adjusted based on the testing/sampling test requirements, and, in particular, may be stopped, increased, reduced, oscillated, or maintained at a constant or predetermined level. Also, downhole measurements (such as formation response measured by the formation testing or sampling tool, downhole power available to the formation testing or sampling tool, wellbore pressure measured by the formation testing or sampling tool, etc) may be sent to the well site, and commands may be sent from the well site to the formation testing or sampling tool, regardless of the mud circulation rate. In some cases, the mud circulation rate may be adjusted based on the downhole measurements obtained by the formation testing or sampling tool relating to the tool, the wellbore or the formation surrounding the wellbore.

In FIG. 1, a schematic view of a well site system is generally shown. The well site may be onshore (as shown) or offshore. In this exemplary system, a wellbore 11 is formed in subsurface formations 30, such as by rotary drilling, in any manner appreciated by those having ordinary skill in the art. In the example of FIG. 1, the surface system may include drilling fluid (or mud) 26 that may be stored in a tank or pit 27 formed at the well site. A mud circulation pump 29 may deliver the drilling fluid 26 to the interior of the drill string 12 via a port in the swivel 19, causing the drilling fluid 26 to flow downwardly through the drill string 12 as indicated by the directional arrow 8. The drilling fluid 26 may exit the drill string 12 via ports in the drill bit 105, and then may circulate upwardly through the annulus region between the outside of the drill string 12 and the wall of the wellbore 11, as indicated by the directional arrows 9. In this well known manner, the drilling fluid 26 may lubricate the drill bit 15 and may carry formation cuttings up to the surface, whereupon the drilling fluid 26 may be cleaned and returned to the pit 27 for recirculation. As is known in the art, sensors may be provided about the well site to collect data, preferably in real time, concerning the operation of the well site, as well as conditions at the well site. For example, such surface sensors may be provided to measure parameters such as standpipe pressure, hook load, depth, surface torque, rotary table rotations per minutes (rpm), among others.

A drill string 12 may be suspended within the wellbore 11 and may include a bottom hole assembly (BHA) 100 proximate the lower end thereof. The drill string 12 may comprise casing, conventional drill pipes whether single-shouldered or double shouldered, wired drill pipes, coiled tubing, other tubing known to those having ordinary skill in the art and/or a combination of the same. The BHA 100 may include a drill bit 105 at its lower end. It should be noted that in some implementations, the drill bit 105 may be omitted, and the bottom hole assembly 100 may be conveyed via tubing or pipe. The surface portion of the well site system may include a platform and derrick assembly 10 positioned over the wellbore 11, the derrick assembly 10 including a rotary table 16, kelly 17, hook 18 and rotary swivel 19. The rotary table 16 may engage the kelly 17 at the upper end of the drill string 12. The drill string 12 may be rotated by the rotary table 16, which is itself operated by well known means not shown in the drawing. The drill string 12 may be suspended from the hook 18. The hook 18 may be attached to a traveling block (not shown) through the kelly 17 and the rotary swivel 19, which permits rotation of the drill string 12 relative to the hook 18. As is well known, a top drive system (not shown) could alternatively be used instead of the kelly 17 and rotary table 16 to rotate the drill string 12 from the surface.

The bottom hole assembly 100 may include an interface sub 110, a logging-while-drilling (LWD) module 120, a measuring-while-drilling (MWD) module 130, and a hydraulically operated motor system 150 operatively coupled to the drill bit 105. Optionally, the system 150 may further include a rotary-steerable system for directional drilling. The bottom hole assembly 100, such as in the LWD module 120 and/or the MWD module 130, may contain one or more tools or sensors for measuring a characteristic and/or property of the drill string 12, the wellbore 11, and/or the formation surrounding the wellbore 11. The bottom hole assembly 100 may provide directional information, such as an azimuth and an inclination, related to the wellbore 11 or the drill string 12. In addition, the bottom hole assembly 100 may provide a device for transmitting information, whether coded, compressed, decoded, or uncompressed to the surface. The bottom hole assembly 100 may contain a processor for computing and generating instructions without communication with the surface.

For example, the LWD module 120 may be housed in a special type of drill collar, as is known in the art, and may contain one or a plurality of known types of well logging instruments. It will also be understood that more than one LWD module may be employed, for example, as represented at 20A (references, throughout, to a module at the position of LWD module 120 may alternatively mean a module at the position of LWD module 20A as well). The LWD module 120 may include capabilities for measuring, processing, and storing information, as well as for communicating with the MWD module 130. In particular, the LWD module 120 may include a downhole processor configured to implement one or more aspects of the methods described herein. In the present example, the LWD module 120 includes a formation testing and/or formation sampling tool as will be further explained hereinafter.

For example, the MWD module 130 may also be housed in a special type of drill collar, as is known in the art, and may contain one or more devices for measuring characteristics of the drill string 12 and the drill bit 15. In an embodiment, the MWD module 130 may include one or more of the following types of measuring devices: a weight-on-bit measuring device, a torque measuring device, a vibration measuring device, a shock measuring device, a stick slip measuring device, a direction measuring device, and an inclination measuring device. Optionally, the MWD module 130 may further comprise an annular pressure sensor, and a natural gamma ray sensor.

The MWD module 130 may further include a power source (not shown) for providing electrical power to the downhole portion of the well site system. For example, the MWD module 130 may include a power sub of a type described in PCT Patent Application Pub. No. WO 2009/042494, which is hereby incorporated by reference, and may comprise a mud turbine powered by the flow of the drilling fluid 26, the mud turbine being coupled to an alternator, battery systems, such as rechargeable batteries, downhole fuel cells or other power source. In an embodiment, the alternator may be used to recharge the batteries as desired. However, it should be understood that other power sources, such as a line through the pipes 180 carrying power from surface, may be used while remaining within the scope of the present disclosure. It should be appreciated that transferring power thorough the drill string 12, such as through a wired drill pipe telemetry system, may be used.

The interface sub 110 may provide an interface between the communications circuitry of the MWD module 130 and the drill string telemetry system. For example, the interface sub 110, which can also be provided with sensors, may be of a type described in U.S. Patent Application 2007/0030162, which is hereby incorporated by reference. The interface sub may provide communication protocols to communicate with the tools of the bottom hole assembly 100 and/or changing the protocols of signals sent from the BHA 100 to the surface.

In the example shown in FIG. 1, a WDP telemetry system may be employed for reliably transmitting data in relatively high-data rates (compared to mud pulse telemetry), bidirectionally (i.e., uplinks and/or downlinks), between the logging and control unit 4 and the components of the MWD module 130. Accordingly, the configuration shown in FIG. 1 provides a communication link from the logging and control unit 4 through a communication link 175, to a surface sub 185, through the WDP telemetry system, to downhole interface 110 and the components of the bottom hole assembly 100 and, also, the reverse thereof, for bidirectional operation.

The WDP telemetry system may comprise a system of inductively coupled wired drill pipes 180 that extend from a surface sub 185 to an interface sub 110 in the bottom hole assembly. For example, the wired drill pipes may include inductive couplers, such as at the pipe joints, such as described in U.S. Pat. Nos. 6,641,434 and 6,866,306, incorporated herein by reference. Depending on factors including the length of the drill string, relay subs or repeaters may be provided at intervals in the string of wired drill pipes, an example being represented at 182. The relay subs, which may also be provided with sensors, are further described in U.S. Patent Application Pub. No 2009/0173493, incorporated herein by reference.

A surface sub or surface interface 185 may be provided at the top of the wired drill string. The surface sub or surface interface 185 may provide a communication link between the topmost wired drill pipe and the logging and control unit 4. For example, a communication link 175 is schematically depicted between the electronics and antenna of the uphole interface and the logging and control unit 4. For example, the surface sub or surface interface 185, may be coupled with electronics 35 that rotate with kelly 17 and include a transceiver and antenna that communicate bidirectionally with antenna and transceiver of logging and control unit 4.

The logging and control unit 4 may include a controller having an interface configured to receive commands from a surface operator. Thus, commands may be sent to one or more components of the BHA 100, and more specifically to the LWD tool 120. Also, commands may be sent to the circulation pump 29 to adjust or control the mud circulation rate. The mud circulation rate may be decreased, increased, or maintained at a constant value. The mud circulation rate may be changed based on measurements of the BHA 100, such as a measurement related to the wellbore 11, the formation surrounding the wellbore 11 and/or the drill string 12. In addition, the mud circulation rate may be changed based on a status or property of one of the tools of the BHA, such as the formation testing or sampling tool, for example, operating temperature, power usage, power consumption, error, vibration, shock, or any property effecting its operation. The mud circulation rate may be changed based on formation evaluation or other tests performed from one of the tools of the BHA 100. In an embodiment, the mud circulation rate may be set to a level that avoids hindrance or interruption of operation of one of the tools of the BHA 100.

The logging and control unit 4 may also comprise an uphole processor system configured to implement one or more aspects of the methods described herein. For example, the surface processor may perform one or more of the following functions: receiving and/or sending data, logging information, and/or control information to and/or from downhole and surface equipment, performing computations and analyses, and communicating with operators and with remote locations. The surface processor may be configured to translate the transmitted measurements made by the LWD tool 120 into data useful in the operation of the LWD tool 120, for example using a tool-formation simulator.

As previously mentioned, the LWD tool 120 may include a formation testing and/or formation sampling tool. For example, the formation testing and/or formation sampling tool may include a fluid admitting assembly having an inlet, such as an extendable probe and/or a dual inflatable packer, a fluid pump, such as a positive displacement pump driven by one or more electric motors and drive/control electronics capable of performing accurate fluid drawdowns as well as pumping fluid from the formation, and fluid storage chambers and associated carriers in cases where formation fluid samples are desired. The formation testing and/or formation sampling tool may further include one or more of wellbore pressure, formation fluid pressure, flow rate/volume and temperature sensors. The formation testing and/or formation sampling tool may still further include composition, and thermodynamic property sensors, such as described in "*New Downhole-Fluid Analysis-Tool for Improved Reservoir Characterization*" by C. Dong et al. SPE 108566, December 2008, incorporated herein by reference. The formation testing and/or formation sampling tool may still further include tool component instrumentation (e.g., alternator, motor, and/or electronics temperature sensors, actuator position, force or torque sensors, etc). Example description of formation testing and/or sampling tools may be found in U.S. Patent Application Pub. Nos. 2008/0156486, 2009/0166085, both incorporated herein by reference.

The LWD tool 120 may include a downhole mud logging tool. For example, U.S. Pat. App. Pub. No 2007/0137293, incorporated herein by reference, describes a downhole mud logging tool which performs the composition measurements of the formation hydrocarbon released in the drilling fluid as the formation is drilled.

Figure 2:
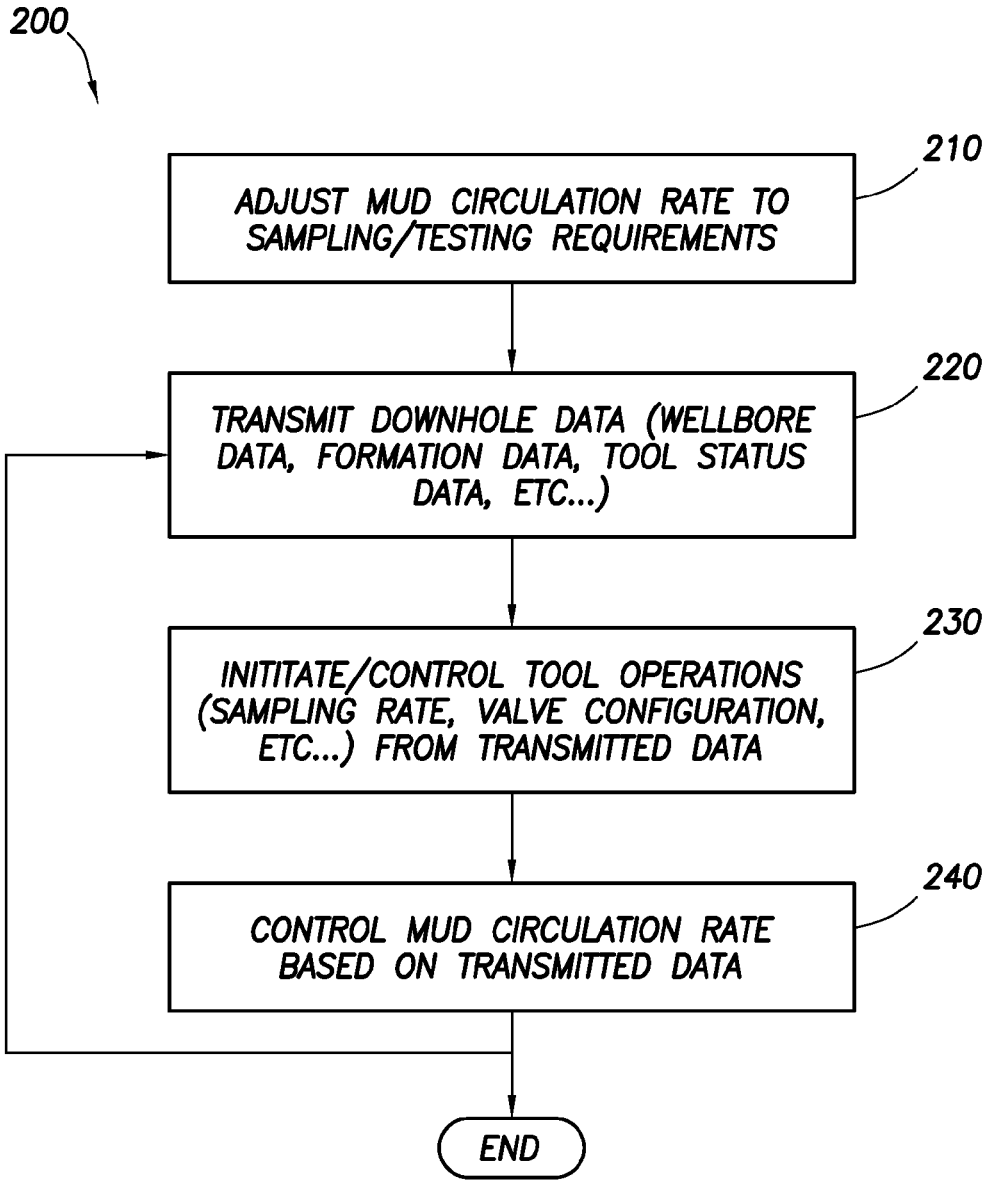
FIG. 2 is a flow-chart diagram of at least a portion of a method according to one or more aspects of the present disclosure.

Turning to FIG. 2, a flow chart of at least a portion of method 200 of adjusting the mud circulation rate when evaluating a formation is shown. The method described in FIG. 2 may be performed, for example, using the well site system described in FIG. 1. It should be appreciated that the order of execution of the steps depicted in the flow chart of FIG. 1 may be changed and/or some of the steps described may be combined, divided, rearranged, omitted, eliminated and/or implemented in other ways within the scope of the present disclosure.

At step 210, the mud circulation rate is adjusted to the requirements of a portion of a testing sequence. In an embodiment, the requirements of the testing sequence may be based on a property of the formation sampling or testing tool or based on a test or process performed by the formation sampling or testing tool, such as measurements or samples obtained from the formation. The requirements of a portion of a testing sequence may include a maximum mud circulation rate, a minimum circulation rate, and/or a range of mud circulation rates that avoid interruption or distortion of the portion of the testing sequence. For example, in some cases, the mud circulation rate may be maintained at an essentially constant rate to reduce pressure disturbances in the formation and/or the probe interface. In particular, the mud circulation may be interrupted if the first test portion benefits from a low circulation noise environment. In some cases, the mud circulation rate may be set to a level that provides adequate downhole cooling of the formation testing or sampling tool or other tools. In some cases, the mud circulation rate may be set to a level that provides adequate downhole power to the BHA 100 and/or the formation sampling or testing tool via the turbine/alternator in the power sub (downhole power may vary like the cubic power of the mud circulation rate). However, power may be provided to the BHA 100 from a combination of mud circulation and downhole battery, or downhole battery only if available. In some cases, the mud circulation rate may also be adjusted to provide sufficiently low mud filtration rate in the formation. Lower mud circulation may facilitate the build-up/thickening of the mud cake, which in turn reduces the mud filtration rate. A reduced mud filtration rate may in turn lead to downhole samples having a lower contamination level by mud filtrate. In some cases, the mud circulation rate may be oscillated to generate pressure pulses in the formation.

Regardless of the mud circulation rate, downhole data measured, for example, by the testing/sampling tool, is transmitted to the surface at step 220, typically via a telemetry system, such as WDP telemetry. For example, the downhole data may include wellbore data such as wellbore pressure; wellbore dimension and shape information, for example various "calipers"; wellbore fluid property data, for example, density and viscosity, filtration characteristics and mud thickness data; local mud flow rate; and others. Downhole data may include tool status data or metrics. Tool status data or metrics may include data related to the power available for the downhole operation, such as charge level of downhole batteries, data points defining a power curve of the turbine or other parameters describing the level of power available or consumed. It should be appreciated here that the power available downhole, for example from a turbine, is difficult to infer from surface measurements, such as mud circulation rate. Tool status or metrics may also include data related to the power required by the downhole operation, such as the mechanical power needed to extract or inject fluid from the formation into the wellbore at a particular rate, the mechanical power needed to extend setting pistons out of the tool (and lift the tool), etc. Tool status data or metrics may also include data related to the power consumed by the downhole operation, such as current levels, voltage levels, and electrical power levels (electrical power generated by an alternator coupled to the turbine). Tool status data or metrics may also include data related tool component temperatures (e.g., alternator, motor, and/or electronics temperatures, etc) hydraulic pressures, component stresses, measured vibrations, component positions and/or internal tool states. Downhole data may also include formation data, such as formation properties that may be used to correlate the formation testing or sampling tool to the geology of the formation (formation evaluation logs), and in particular, borehole electrical, acoustic and nuclear (density, GR) images, and/or nuclear spectroscopy measurements as delivered by the ECS tool. If available, formation data may also include formation pressure response (such as the pumping pressure measured during pump induced flow rate sequence, pretest pressure profiles resulting from tests performed at a series of vertically distributed stations.) If available, formation data may also include formation fluid properties (in particular, fluid composition and mud filtrate contamination levels or other physical measurements such as density, viscosity, resistivity, or the like). A surface control logic and electronics is configured to receive, and optionally display, the transmitted downhole data to a local or remote operator. The surface control logic and electronics may be or may be incorporated into the logging and control unit 4, which may include a surface processor, database, and memory. The surface control logic and electronics may have stored algorithms, models, previously obtained data or measurements relative to an analysis, manufacturing specifications, operating requirements or specifications or any other data related to an analysis of the data or measurements.

The downhole data may be used to initiate or control the testing/sampling tool operations, such as pumping rate, valve configurations to route the downhole fluid in the testing/sampling tool, or etc. at step 230. For example, the surface control logic and electronics may receive commands from a surface operator via an interface (via a key board or remotely over internet), or may be fully automated.

Alternatively or additionally, the circulation rate of the mud generated by the surface pump may be controlled based on the transmitted downhole data at step 240, for example based on recommendations displayed by the surface or automatically. In an embodiment, based on an analysis of the data, the mud circulation rate may be controlled automatically, such as without human interaction. A processor, whether downhole or at the surface, such as at the logging and control unit 4, may analyze the data and initiate a command or signal directly or indirectly to change the mud circulation rate. Examples of the operations performed in the method 200 are provided in the description of FIGS. 3A, 3B, 4A, 4B, 5A, 5B, 6A, 6B, 6C, 7A, 7B and 8. It should be noted that the disclosure and following disclosed embodiments discuss many instances where the surface processor and/or the operator may change the circulation rate, maintain the circulation rate, vary the circulation rate or fluctuate the circulation rate. Control of the circulation rate may be based on an analysis of data or measurements obtained downhole or at the surface, such as a measurement related to the wellbore 11, a measurement related to the drill string 12, a measurement of the formation about the wellbore 11, a measurement of the drilling fluid 26 and/or, a measurement of the drill bit 15. The measurement or data may relate to an operation of one of the tools, sensors or other components of the BHA 100, such as operation of the formation testing or sampling tool. The measurement or data may relate to improving measurements obtained from the formation sampling tool. The disclosure and embodiments described below illustrate analysis of the data or measurements that may be performed by a surface processor (and/or related electronics and components), an operator or a combination thereof. For example, the analysis may be performed by use of an algorithm, model, previously calculated data or measurements, manufacturing specifications, operating specifications, and/or similar wellbores drilled or logged previously.

Figure 3A:
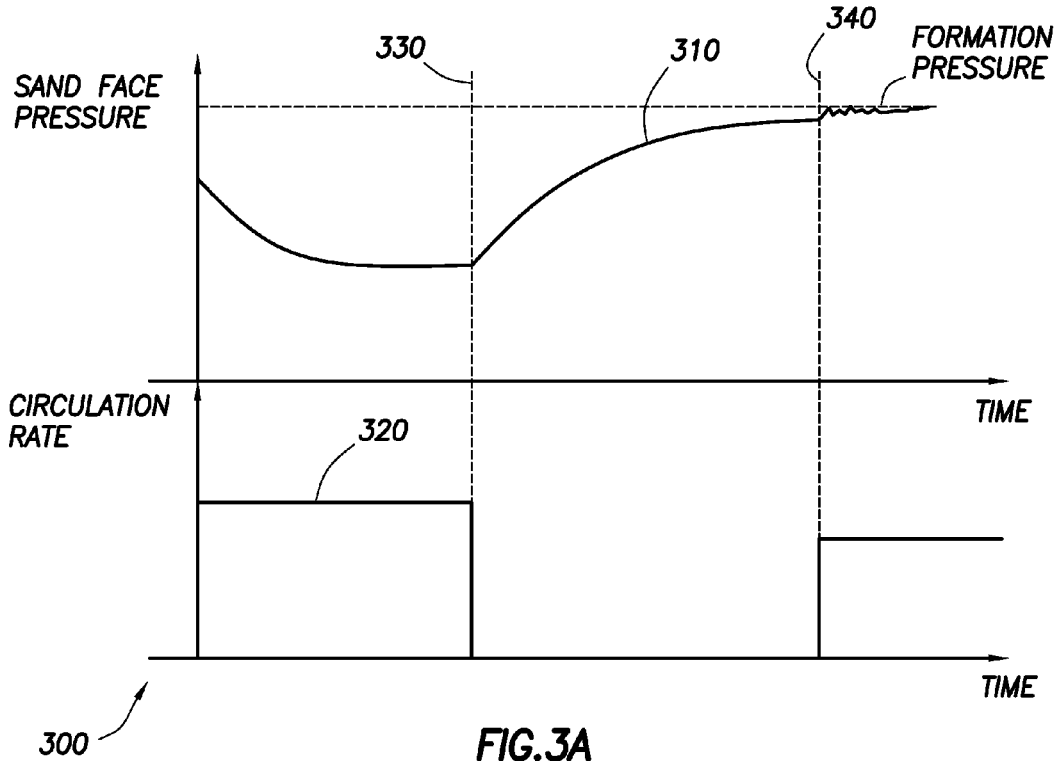
FIG. 3A is an example graph illustrating a method according to one or more aspects of the present disclosure.
Figure 3B:
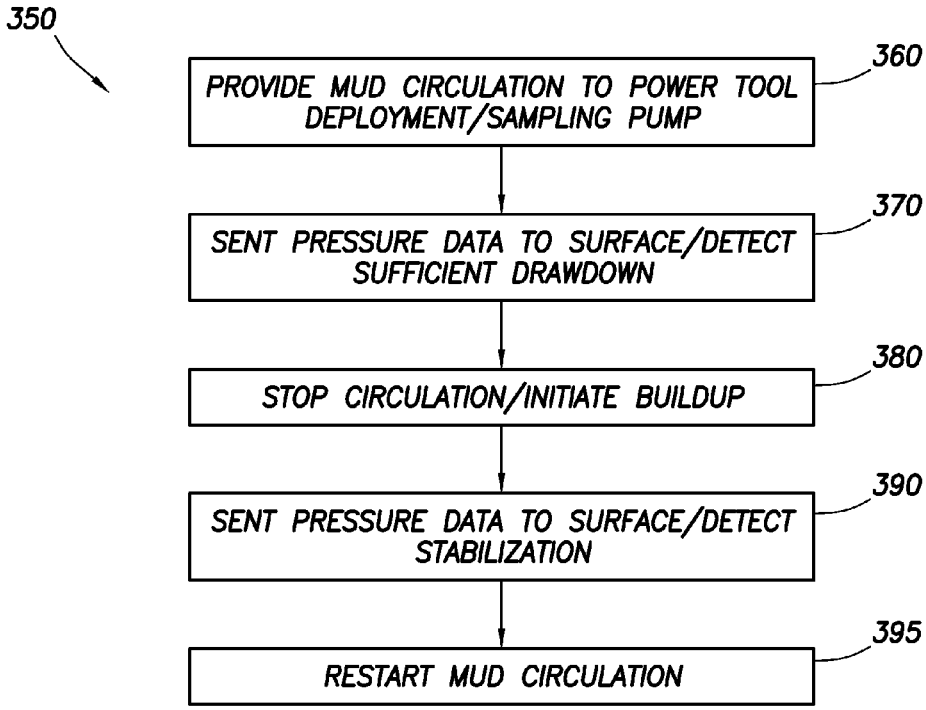
FIG. 3B is a flow-chart diagram of at least a portion of a method according to one or more aspects of the present disclosure.

Referring collectively to FIGS. 3A and 3B, an example graph 300 and an example method 350 are shown, in which the mud circulation rate is interrupted to provide "pumps-off" time interval. The pumps-off" time interval may be desired to acquire, for example, high quality pressure buildup data. A pumps-off time interval may be useful to limit pressure noise to the formation pressure measurements that may otherwise be caused by mud circulation and/or mud pulsing, masking or shifting the formation response and reducing the accuracy, resolution and value of the measurements. Such a strategy is particularly advantageous when the objective of the test is to detect and identify the presence of reservoir limits, the effects of which are evident in the late-time buildup data where the temporal variation in pressure is very small. However, a low and essentially stationary mud circulation may be alternatively provided, for example to reduce the risk of sticking the pipe against the formation. Stopping and/or restarting the mud circulation (the mud pump) before or after a quiet period based on transmitted downhole data may be useful to minimize the time on station, while still insuring some test objectives, for example, that a particular phase of a formation test has achieved a suitable result. This expedites the duration needed to perform formation evaluation, which is useful in those environments where the risk of tool sticking is high.

For example, the method 350 may be performed using a formation testing or sampling tool that may include a mud circulation diverter sub between the power sub and the formation testing or sampling tool. In this instance pressure disturbances are still propagated down the wellbore to the level of the formation testing tool, albeit with diminished effect on the testing tool measurement. The formation testing or sampling tool may be provided with a straddle packer to establish a pressure communication between the tool and the formation.

At step 360, the mud circulation rate, for example as illustrated by the circulation rate versus time curve 320, is provided to deploy the tool and subsequently may be used to power a pump performing a drawdown. Pressure data, for example as illustrated by the sand face pressure versus time curve 310, are continuously sent to the surface control logic and electronics, thereby permitting detection when a sufficient drawdown pressure has been achieved at step 370. At this point, indicated by the time 330, the surface control logic and electronics may stop mud circulation. The formation testing or sampling tool may initiate a pressure build-up analysis, for example by closing fluid isolation valves, based on commands received from the surface.

The pressure data during the build-up portion of the test may be transmitted to the surface control logic and electronics at step 390, for example to determine when the pressure data indicate a change in the flow regime and possible presence of a boundary. If desired, the test may be terminated once sufficient data has been acquired and the test objectives have been met. Alternatively, the test may be extended until the pressure has stabilized, for example. At that point, indicated by the time 340, circulation may be restarted at step 395, for example to perform other tests, such as formation fluid sampling, and/or to retract the probe/packer elements if desired.

While FIGS. 3A and 3B describe a build-up test, other test including tests requiring power may be performed during the pumps-off portion. In that case, the power may be drawn from downhole power source, such as batteries, rechargeable batteries, a fuel cell or other power source. In the case of a downhole power source comprising (rechargeable) batteries, the formation testing or sampling tool may send the charge level of the batteries to the surface control logic and electronics. Testing/sampling operation may continue until battery charge becomes insufficient, at which point circulation may resume, for example to recharge the batteries. Alternatively, in the case of non-rechargeable batteries the tool may be retrieved at the surface to replace the batteries or provide another power source. Further, the operations of the formation testing or sampling tool, such as pumping rate, sample capture, and the like may be controlled based on measurements sent to the surface control logic and electronics during pumps-off, even if the mud circulation is interrupted or is below a level suitable for mud pulse telemetry.

Figure 4A:
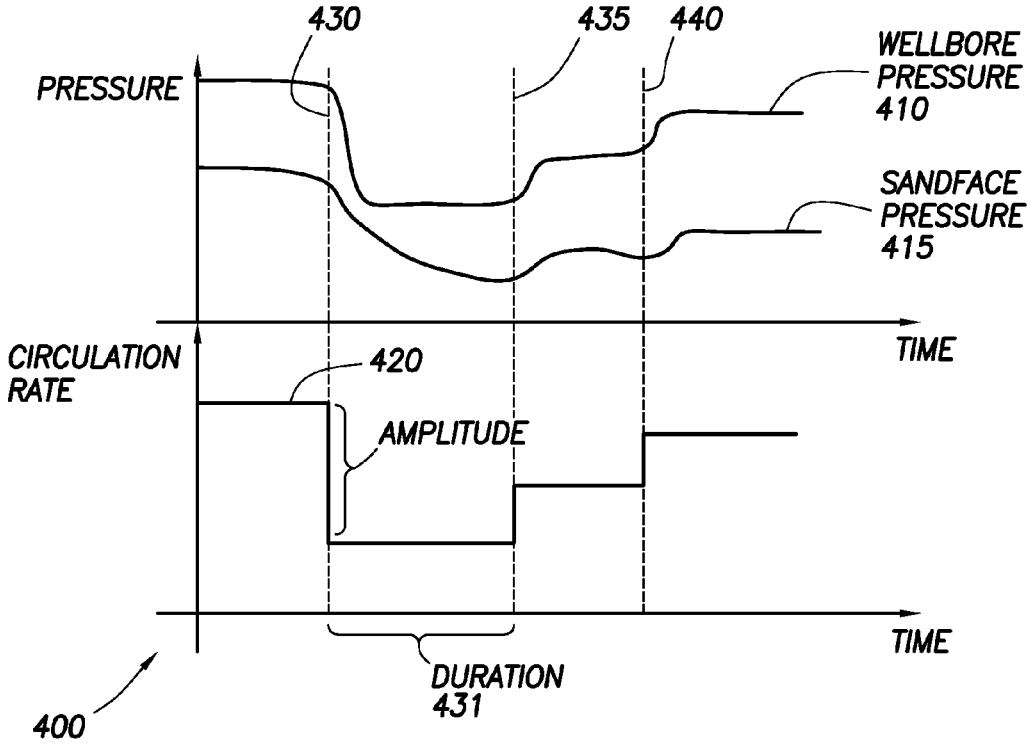
FIG. 4A is an example graph illustrating a method according to one or more aspects of the present disclosure.
Figure 4B:
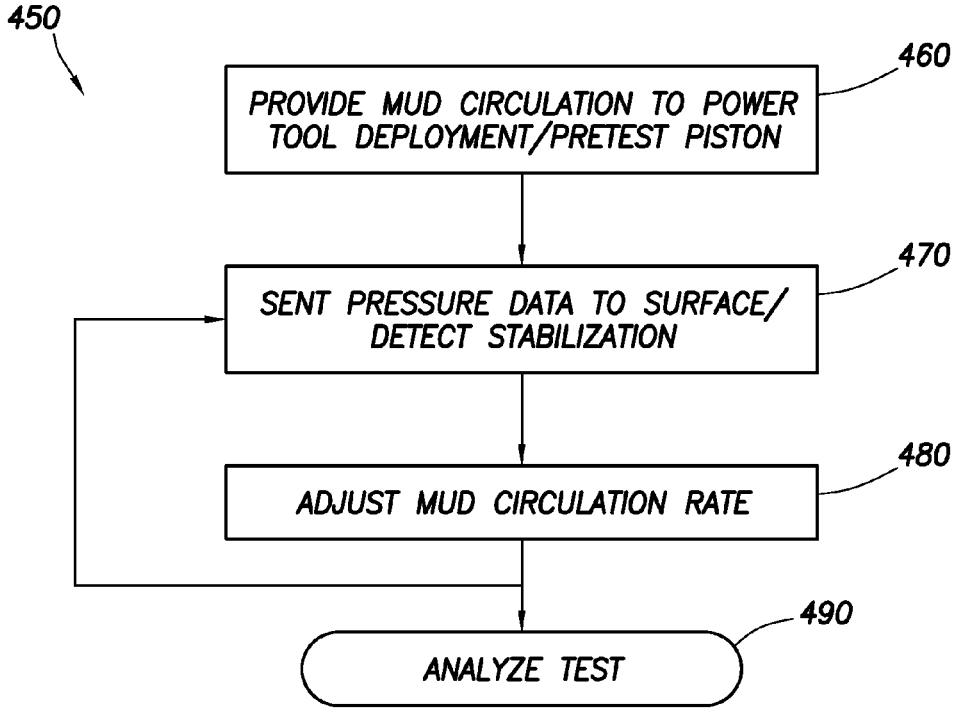
FIG. 4B is a flow-chart diagram of at least a portion of a method according to one or more aspects of the present disclosure.

Referring collectively to FIGS. 4A and 4B, an example graph 400 and an example method 450 are shown, in which the mud circulation rate is deliberately varied, for example oscillated, so as to induce pressure changes in the well through the equivalent circulating density (ECD) effect. Measurements of the sand face pressure variations and/or wellbore pressure in response to the deliberately induced changes in wellbore pressure are used to characterize the resistance to filtrate leak off offered by the mud cake and the formation flow properties, and, from these, to estimate the current filtrate leak off rate and, thence, the amount by which the sand face pressure is elevated over values at great distances (the formation pressure). In this example, the mud circulation rate is varied in series of steps. It should be understood that, although the method has been illustrated with a circulation sequence consisting of a series of steps, any systematic variation in the circulation rate may be used to the same effect, in particular, a sinusoidal variation. For example, the method 450 may be performed using a formation testing or sampling tool that may include a probe for sealing a portion of the formation wall and a drawdown piston for performing at least one pretest.

At step 460, the mud circulation rate, for example as illustrated by the circulation rate versus time curve 420, is provided and may be used to power the extension of setting pistons and/or a probe into contact engagement with the wellbore wall. Further, the power may be used to perform a pretest with the pretest piston. Alternatively, the mud circulation may be used to recharge downhole batteries to an adequate level to perform the test using the electrical power stored in the batteries. The pretest may be used to breach the mud cake and establish pressure communication between the sand face and a pressure gauge in the downhole tool disposed in a flow line connected to the probe inlet.

Pressure measurements in the flow line, for example as illustrated by the sand face pressure curve 415, may be sent to surface via the telemetry system, such as the WDP telemetry system at step 470. The pressure measurements may be displayed to ensure that the tool has successfully sealed against the wellbore wall and that the pretest has performed a valid test. Also, the pressure measurements may be utilized to detect whether the flow line pressure has stabilized (not shown).

At this point, indicated by the time 430, the surface processor and/or an operator may decrease the circulation rate at step 480. The circulation rate may be stopped, or decreased below a level at which mud pulse telemetry would be available, such as below a circulation rate of 300 gallons per minute for an example telemetry tool. The circulation rate may be stopped or maintained below a predetermined level to permit Data indicative of sand face pressure (as illustrated by the sand face pressure curve 415) and/or wellbore pressure (for example as illustrated by the sand face pressure curve 410) are still continuously sent to the surface control logic and electronics via the telemetry system by performing step 470. In the illustrated example, the data indicative of the sand face pressure shows that the supercharging pressure dissipates in the formation and that the sand face pressure stabilizes to a lower (less supercharged) level. The stabilization may be detected (for example, the sand face pressure measurements do not change more than a multiple of the gauge resolution). Once stabilization has been detected, prolonging the duration of the portion 431 of the testing/sampling operation may lead to less useful data. To expedite the overall duration of the test (and reduce sticking risk), the portion 432 of the testing/sampling operation may be initiated. At this point (indicated by the time 435), the surface control logic and electronics (or an operator) may increase the circulation rate by performing step 480 again.

While mud pulse telemetry may be available for this circulation rate, mud pulses may generate pressure variations in the wellbore that have an undesired frequency/amplitude, which may diminish the usefulness of the sand face pressure data. Thus, wellbore and sand face pressure data may be sent via another type of telemetry system, such as the WDP telemetry system, by performing step 470 again. In the shown example, supercharge pressure dissipation is once again observed, until stabilization is detected at time 440. The process may be repeated any number of time, increasing or decreasing the circulation rate.

Based on the collected data, a formation pressure may be computed by an inversion algorithm at step 490. For example an inversion algorithm such as described in "*Correcting Supercharging in Formation-Pressure Measurements Made While Drilling*" by P. Hammond et al. SPE 95710, October 2005, incorporated herein by reference, may be used.

Figure 5A:
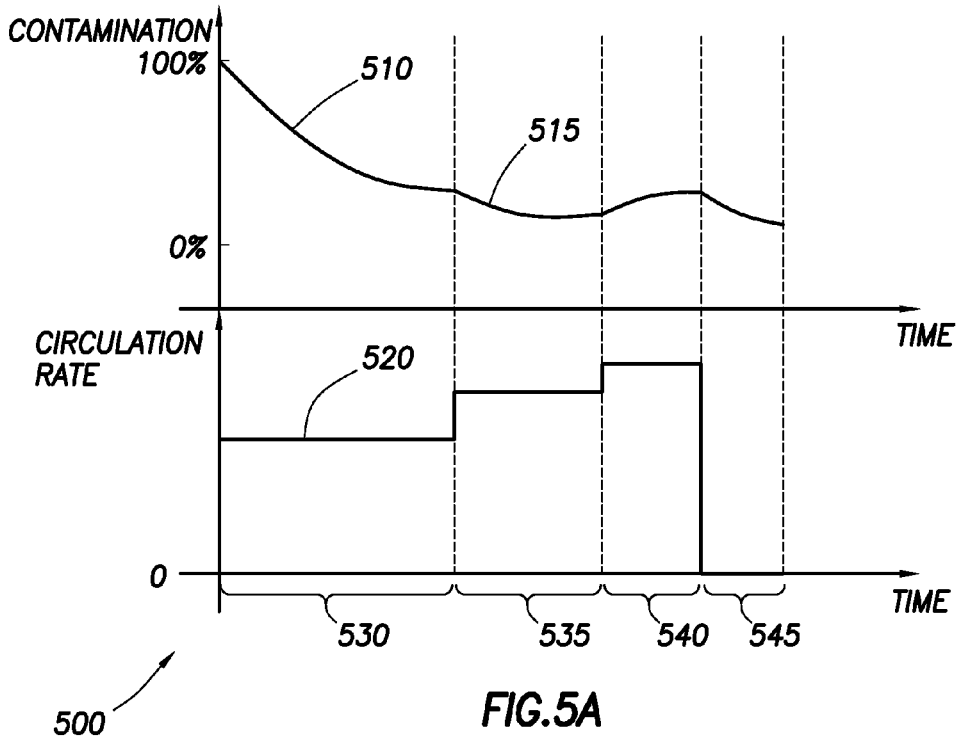
FIG. 5A is an example graph illustrating a method according to one or more aspects of the present disclosure.
Figure 5B:
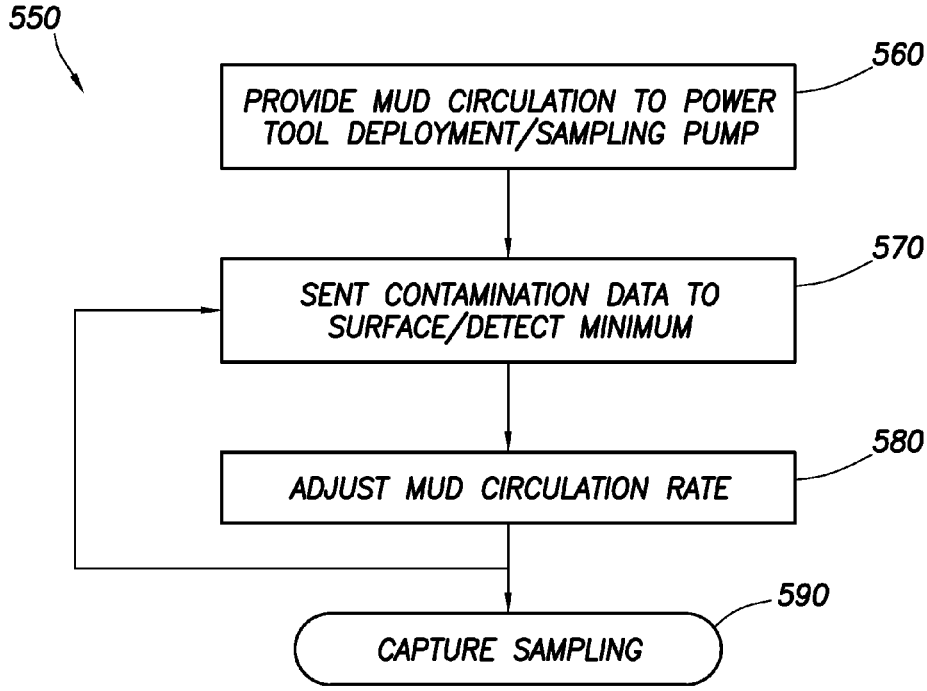
FIG. 5B is a flow-chart diagram of at least a portion of a method according to one or more aspects of the present disclosure.

Referring collectively to FIGS. 5A and 5B, an example graph 500 and an example method 550 are shown, in which the mud circulation rate is "optimized" to acquire, for example, a high quality sample (a sample having a low contamination level by mud filtrate). As is well known, a high rate of mud circulation usually translates into a thinner mud cake, and consequently, into a higher rate of mud filtration into the formation. The higher rate of mud filtration may in turn translate into formation fluid sample having a higher level of contamination. Conversely, a higher rate of mud circulation also translates into a higher electrical power available from a downhole turbine/alternator. In turn, the higher electrical power may permit pumping formation fluid at a higher rate. In some cases, pumping formation fluid at a higher rate will compensate for the high filtration rate and will reduce the contamination of the formation fluid by mud filtrate. In other cases, pumping formation fluid at a higher rate may not be achievable due to hardware constraints or may lead to an undesirable phase change in the formation fluid, and/or may not compensate for the higher filtration rate. In these cases, an increase of mud circulation rate will increase the contamination of the formation fluid by mud filtrate. The "optimum" circulation rate to achieve the lower contamination of the formation fluid is therefore usually unknown, and depends on various factors. It is therefore advantageous to be able to set the mud circulation rate at any desired value (including stopping the circulation), while still keeping the capability of transmitting parameters indicative of the contamination of the pumped fluid by mud filtrate to the surface control logic and electronics for analysis, and keeping the capability of sending commands to the formation testing or sampling tool to capture a sample for example. Thus, it is possible to iterate over a range of circulation rates (including circulations rates that do not permit mud pulse telemetry) while monitoring the impact of the mud circulation rate on formation fluid contamination. A best or better circulation rate may be selected (set) at the surface using this process. For example, the duration of the constant circulation rate intervals, may be determined based on contamination data (once stabilization has been detected). Also, the magnitude of the circulation rate may also be determined based on the contamination data (by adjustments based on the contamination behavior observed during the previous intervals). For example, the method 550 may be performed using a formation testing or sampling tool that may include sensors capable of monitoring a contamination level of the extracted fluid (for example, fluid composition, oil content, methane content, GOR, fluid resistivity, density, viscosity, pH, etc).

At step 560, the mud circulation rate (for example as illustrated by the circulation rate versus time curve 520) is provided, and may be used to power a pump performing a sample extraction (during time interval 530). For example, the mud circulation rate may be adjusted based on the formation fluid mobility estimated with a pretest, and a desired differential pressure (that is the difference between the formation pressure estimated with the pretest and the probe pressure during pumping).

Data indicative of extracted fluid contamination (for example as illustrated by the contamination versus time curve 510) are continuously sent to the surface control logic and electronics, thereby permitting to detect a stabilization (or at least a significant decrease of the rate at which the extracted fluid cleans up) of the contamination level (the dashed curve 515 shows that if the sampling operation were to be continued with the same sampling rate, the contamination may start to increase again because of mud filtration into the formation).

At step 580, the surface processor and/or an operator may change the circulation rate during time interval 535. The circulation rate may be decreased, increased or fluctuated or varied between or about a predetermined range of circulation rates. Data indicative of extracted fluid contamination are still continuously sent to the surface control logic and electronics by performing step 570 again. In the example shown, the data indicative of extracted fluid contamination shows that the extracted fluid cleans-up (i.e., lower contamination) and stabilizes to a lower contamination level. This may be due by the fact that more electrical power is available downhole and that formation fluid pumping can be performed at a higher rate than previously. In this case, the higher fluid pumping rate overcomes the increased filtration rate caused by a higher mud circulation rate.

After stabilization of the contamination level is achieved, the surface processor and/or an operator may again at step 580 increase, decrease, vary or fluctuate the circulation rate during time interval 540. In this case however, the data indicative of extracted fluid contamination shows that the extracted fluid does not clean-up. This may be due by the fact that the increase in filtration rate caused by a higher mud circulation cannot be balanced by a higher pumping rate.

At that point, circulation may be stopped (or reduced), and formation fluid extraction may continue using for example electrical power from downhole batteries (during time interval 545). Data indicative of extracted fluid contamination are still continuously sent to the surface control logic and electronics. In the shown example, the data indicative of extracted fluid contamination shows that the extracted fluid cleans-up (lower contamination) and stabilizes to a lower contamination level. A command may be sent to the formation testing or sampling tool to capture a sample at step 590, if desired.

Figure 6A:
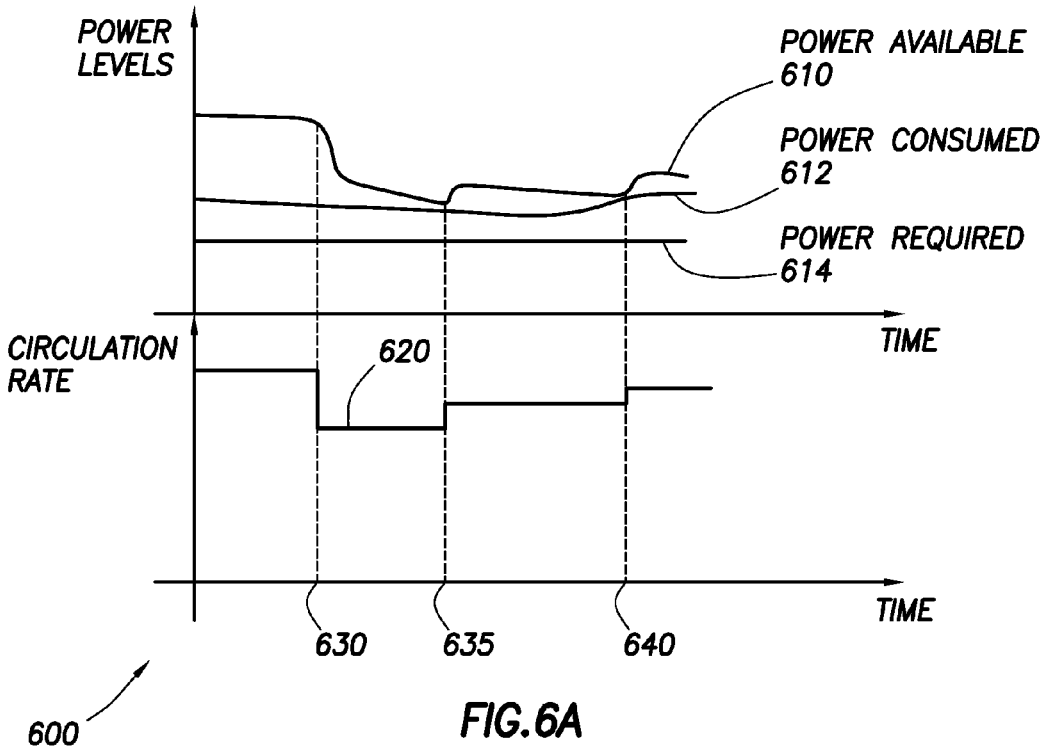
FIG. 6A is an example graph illustrating a method according to one or more aspects of the present disclosure.
Figure 6B:
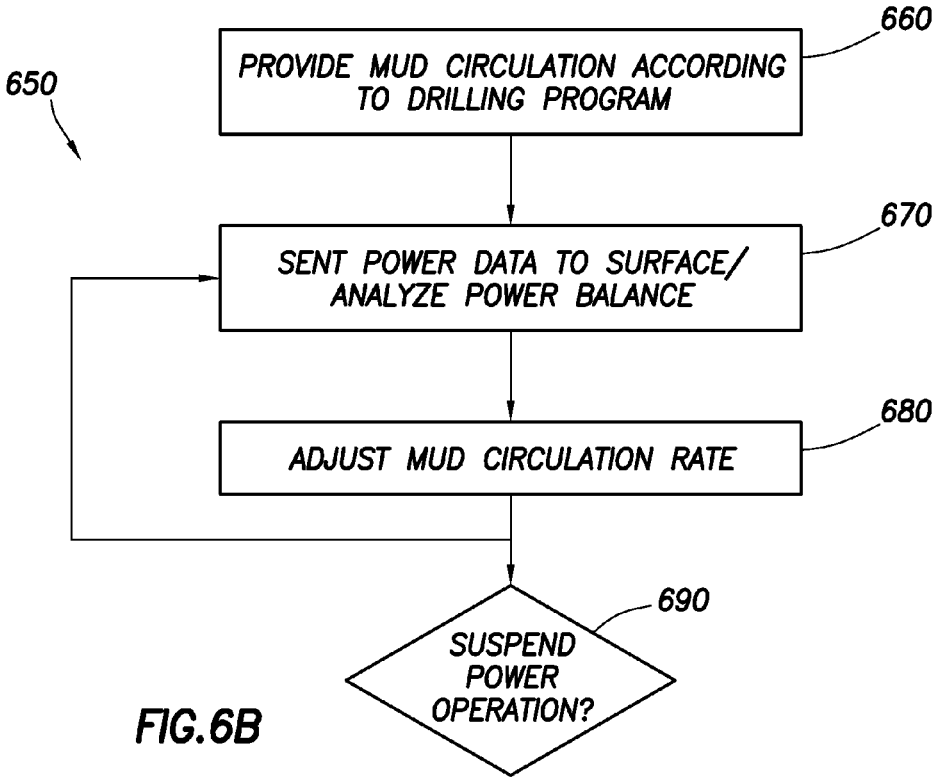
FIG. 6B is a flow-chart diagram of at least a portion of a method according to one or more aspects of the present disclosure.

Referring collectively to FIGS. 6A and 6B, an example graph 600 and an example method 650 are shown, in which the mud circulation rate is adjusted to provide sufficient power to the BHA 100 and/or the formation testing or sampling tool. For example, the flow rate may be minimized while still providing enough power to the BHA 100. By doing so, mud cake erosion may be limited, which may be useful for obtaining good quality test data with the formation testing or sampling tool. Also, by doing so, it may be possible to limit the angular speed of a turbine configured to provide power to the formation, thereby reducing the wear of components in the turbine and/or to limit heat losses due to viscous drag. Regardless of the mud circulation rate, the surface control logic and electronics may receive one or more of data indicative of the power available downhole, data indicative of the power required to perform a testing/sampling operation, and data indicative of the power consumed. These data may be current levels, voltage levels, turbine power versus turbine speed, formation or wellbore properties, etc.

The power available downhole, for example from a turbine, may be difficult to infer from surface measurements, such as mud circulation rate. Indeed, the power available from a turbine depends on various factors beyond the mud circulation rate, including the downhole density of the circulated mud, mud losses between the surface pump and the downhole turbine, temperature of various components of the downhole tool. All these elements may influence the efficiency of a turbine/alternator system. Thus, it may be useful to broadcast downhole measurements regardless of the mud circulation rate for asserting the power available downhole.

The power required by the formation testing or sampling tool may greatly depend on various parameters, sometimes related to the formation response (formation fluid mobility) and/or the wellbore pressure. For example, it is possible to estimate the power required P for sampling formation fluid from a formation from the wellbore pressure $P_{hyd}$, the formation fluid mobility μ (the formation fluid viscosity and the formation rock permeability), the formation pressure $P_{form}$, and the desired extraction rate Q, using the relationship $P=Q.(P_{hyd}-P_{form}-Q.\mu)$. The formation fluid mobility and the formation pressure may be estimated from a pretest measurement or a specially designed pump sequence. Wellbore pressure may be directly measured. The desired extraction rate may be determined so the pumping pressure does not fall below a phase transition pressure of the downhole fluid. In another example, the power required by the formation testing or sampling tool to extend setting pistons may sometimes be related to the tool orientation in the wellbore 11 (for example if the setting piston has to support the weight of the formation testing or sampling tool in an horizontal well or not, depending on the formation testing or sampling tool orientation). Thus, it may be useful to broadcast downhole measurements performed in situ regardless of the mud circulation rate for asserting the power required by the formation testing or sampling tool.

The power consumed by the formation testing or sampling tool may differ from the power required. The power consumed may for example take into account the efficiency or losses of various components of the formation testing or sampling tool (turbine, alternator, and power electronics). The efficiency and/or losses may depend on the temperature of these components and thus may vary. In some cases, decreased efficiency or increased losses may be indicative of a failure. Thus, it may be useful to broadcast downhole measurements regardless of the mud circulation rate for asserting the power consumed by the formation testing or sampling tool.

For example, the method 650 may be performed using a formation testing or sampling tool that may include a turbine coupled to an alternator for providing electrical power to the BHA 100 (the formation testing or sampling tool). The BHA 100 may also include a battery, an accumulator, a rechargeable battery, etc. At step 650, the mud circulation rate (for example as illustrated by the mud circulation rate versus time curve 620) is determined, for example by the drilling program. The formation testing or sampling tool may then initiate a testing/sampling operation.

Data indicative of the power available downhole (for example as illustrated by the power versus time curve 610), data indicative of the power required to perform a testing operation (for example as illustrated by the power versus time curve 614), and data indicative of the power consumed (for example as illustrated by the power versus time curve 612) are transmitted to the surface control logic and electronics at step 670.

In the shown example, these data indicate that sufficient power is initially available downhole at this point (up to the time indicated by numeral 630). Based on the comparison of power levels mentioned above, the circulation rate may be reduced at step 680, for example to a level at which mud pulse telemetry may not be useable (for example, below 300 gpm for some telemetry tools). However, power level data are still transmitted to the surface control logic and electronics (by performing step 670 again).

In the example shown, these data indicate that the power available downhole gradually reduces. This may be caused for example by the depletion of one or more of the downhole batteries. At some point (indicated by the time 635), not enough power is provided downhole. The surface control logic and electronics (or an operator) may then increase the circulation rate by performing step 680 again, for example to increase the power available downhole from the turbine/alternator.

In the example shown, the power consumed downhole gradually increases. This may be caused, for example, by an increase of downhole components temperature, and a resulting decrease of efficiency (increased loss). At this point (indicated by the time 640), the surface control logic and electronics (or an operator) may again increase the circulation rate, to compensate for the loss of efficiency of the downhole components, and/or increase the cooling of the formation testing or sampling tool. Also any excessive power consumption (power consumption greatly exceeding power requirements) may be detected, and the operation of the tool may be suspended before a catastrophic failure occurs at step 690.

Figure 6C:
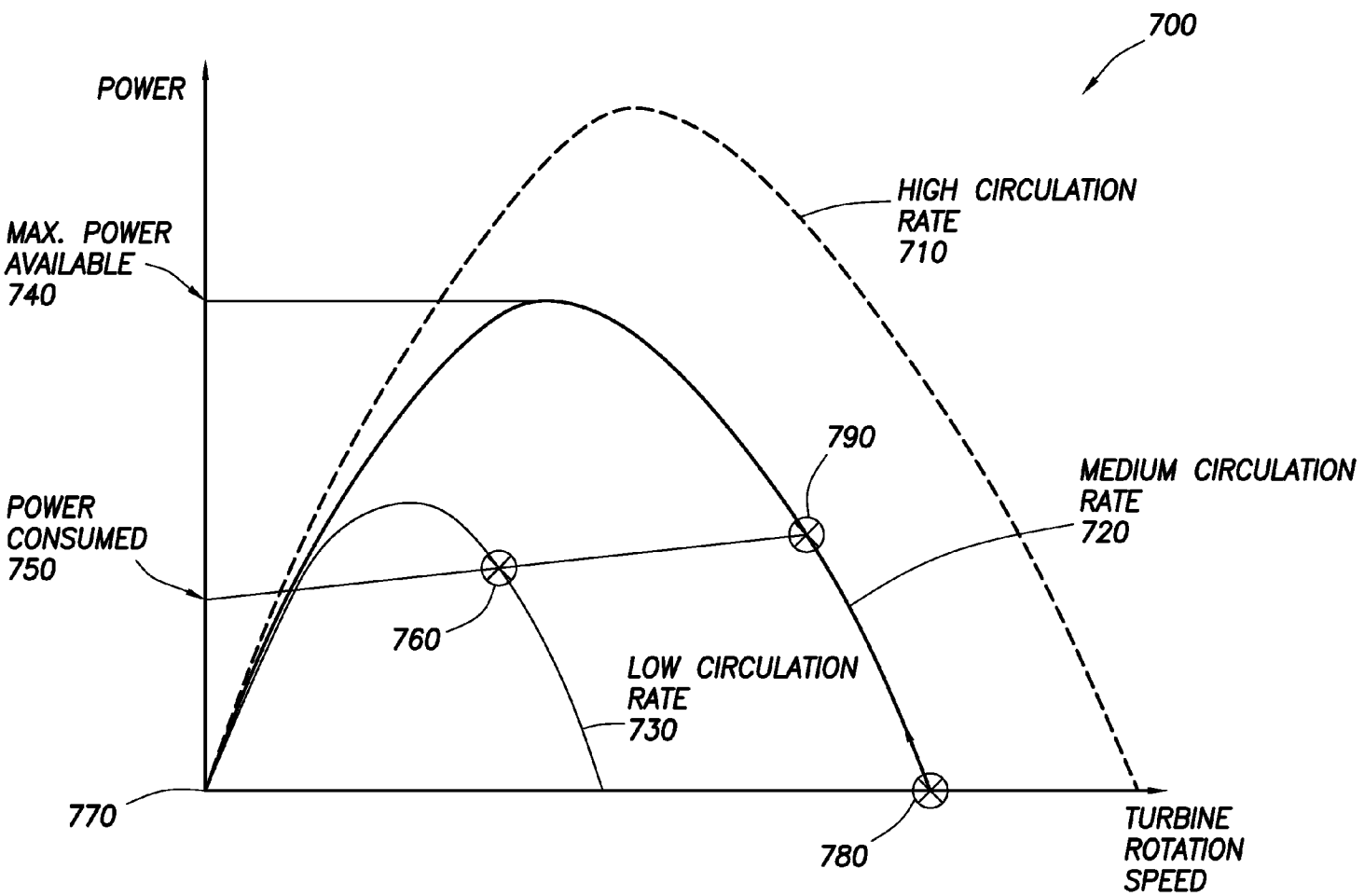
FIG. 6C is an example graph illustrating a method according to one or more aspects of the present disclosure.

Referring to FIG. 6C, an example graph 700 illustrates in more detail how the power available from a turbine may be estimated. Each curve (curve 710, 720 and 730) represents a power curve for a particular mud circulation rate. The power curve depends on the mud circulation rate, the mud downhole temperature (mud viscosity) the mud downhole density, among other things. For example, each curve has a general parabolic shape varying as a function of the turbine angular speed (that can be measured downhole), between 0 rotation per minute or rpm (e.g., data point 770) and the free spin angular speed (e.g., data point 780) corresponding to no load applied to the turbine. As apparent in FIG. 6C, the free spin angular speed that depends on the mud circulation rate. The family of power curves may be characterized by experiments performed on the turbine in a laboratory environment. The family of power curves characterized this way may be used with data points collected in situ. For example, a curve corresponding to a constant circulation rate may be determined by at least 2 points, for example a point corresponding to the testing/sampling tool being idle (e.g., data point 780 corresponding to a low power consumed and high turbine angular speed) and a point corresponding to the testing/sampling tool performing a testing/sampling operation (e.g., data point 790 corresponding to relatively higher power consumed and low turbine angular speed). The power available corresponding to the particular flow rate is indicated by the maximum of the power curve (e.g., power level 740).

In the example shown, the power consumed is sufficiently below the power available (e.g., power level 750). It is possible to determine a new flow rate (for example the low circulation rate corresponding to curve 730) that would provide sufficient power. For example, a cubic law of the available power versus mud circulation rate may be used. The circulation rate may be adjusted to this new value. This would reduce the angular speed of the turbine as indicated by data point 760, and thereby it may reduce the turbine wear and/or heat generation.

Figure 7A:
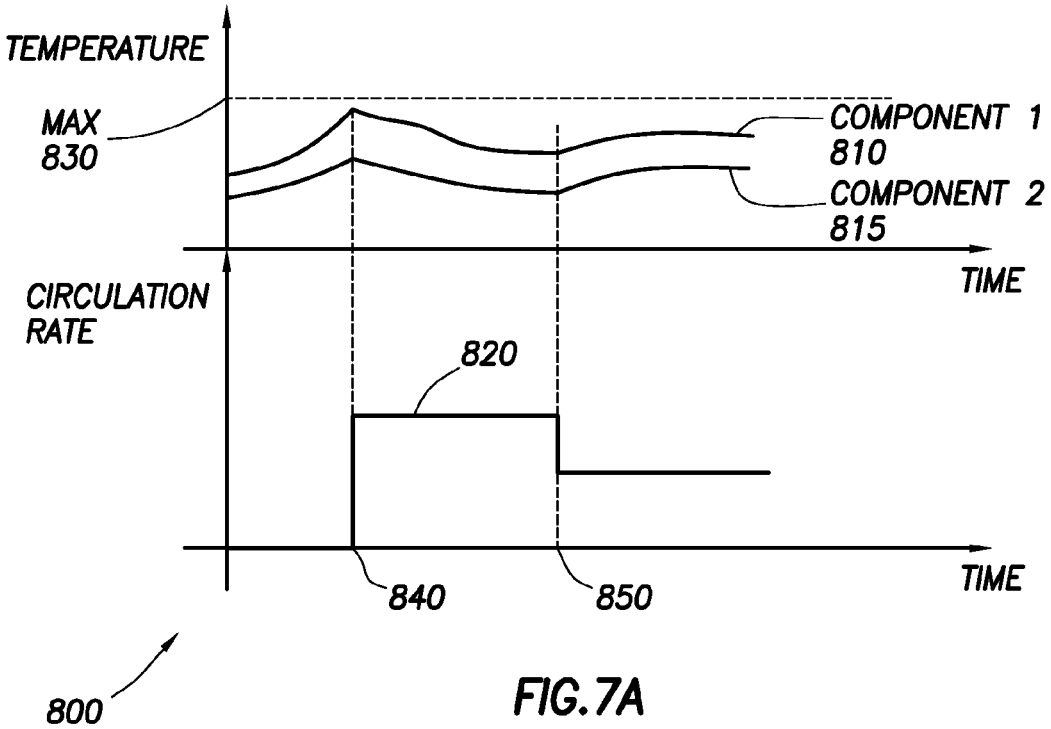
FIG. 7A is an example graph illustrating a method according to one or more aspects of the present disclosure.
Figure 7B:
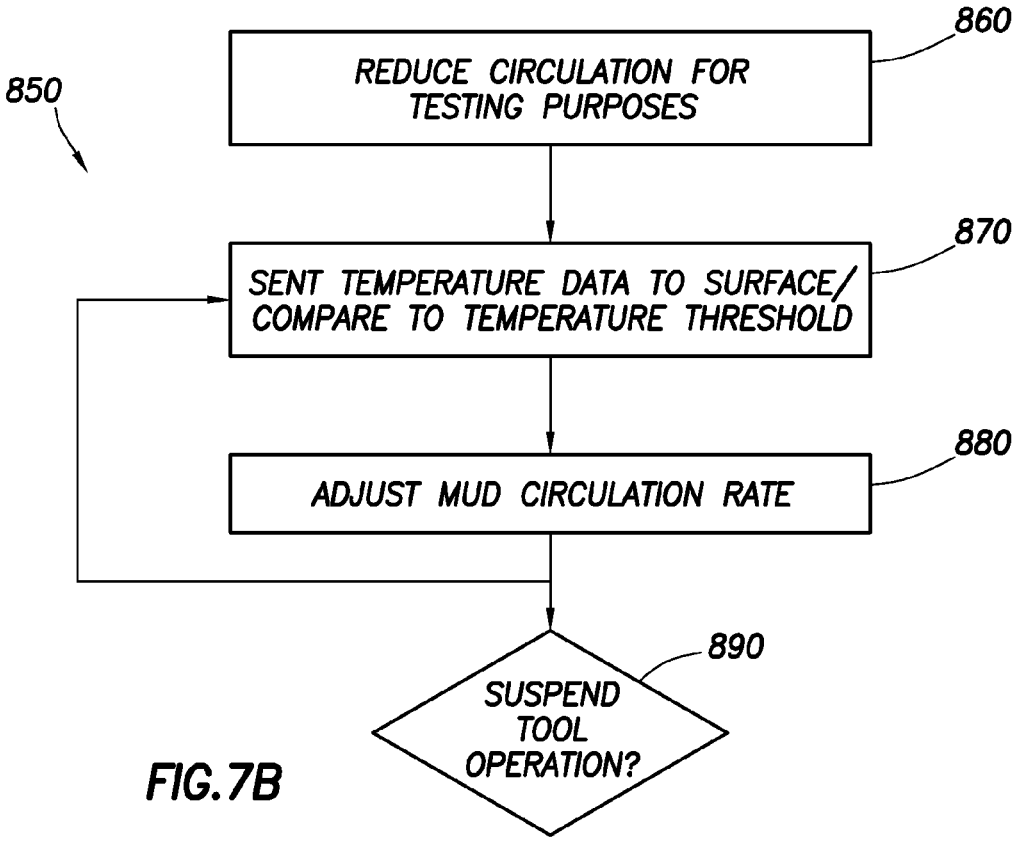
FIG. 7B is a flow-chart diagram of at least a portion of a method according to one or more aspects of the present disclosure.

Referring collectively to FIGS. 7A and 7B, an example graph 800 and an example method 850 are shown, in which the mud circulation rate is adjusted to control the temperature of components in the BHA 100 (or in the formation testing or sampling tool). The temperature of one or more components (for example as illustrated by the temperature versus time curves 810 and 815) of the testing/sampling tool is monitored during an operation. At step 860, the mud circulation (for example as illustrated by the mud circulation rate versus time curve 820) is interrupted (or is low).

Despite the low mud circulation rate, a non-mud pulse telemetry system, such as the WDP telemetry system, is capable of transmitting to the surface control logic and electronics one or more temperature curves at step 870. These temperatures may be compared to the tool specifications (for example the maximum temperature threshold 830). In the shown example, the temperature increase because of electric dissipation into heat during the testing/sampling operation. Because of the low mud circulation rate, the generated heat is not well evacuated and accumulates in the wellbore.

At this point (indicated by the time 840), the mud circulation may be increased to promote cooling of the formation testing or sampling tool. However, in some cases, tool operations may be interrupted at step 890, and resumed after letting the tool cool. In other cases, the tool operations may be resumed using testing parameters that are still in an acceptable range for limiting the tool failure (lower pumping power).

In the shown example, increasing the mud circulation rapidly cools the tool. At this point (indicated by the time 850), the mud circulation rate may be reduced (for example to provide lower mud cake erosion and/or lower pressure disturbances). In the shown example, the temperature curves show that this circulation rate is adequate for cooling the downhole tool, whether the formation testing or sampling tool or other tool in the BHA 100.

Figure 8:
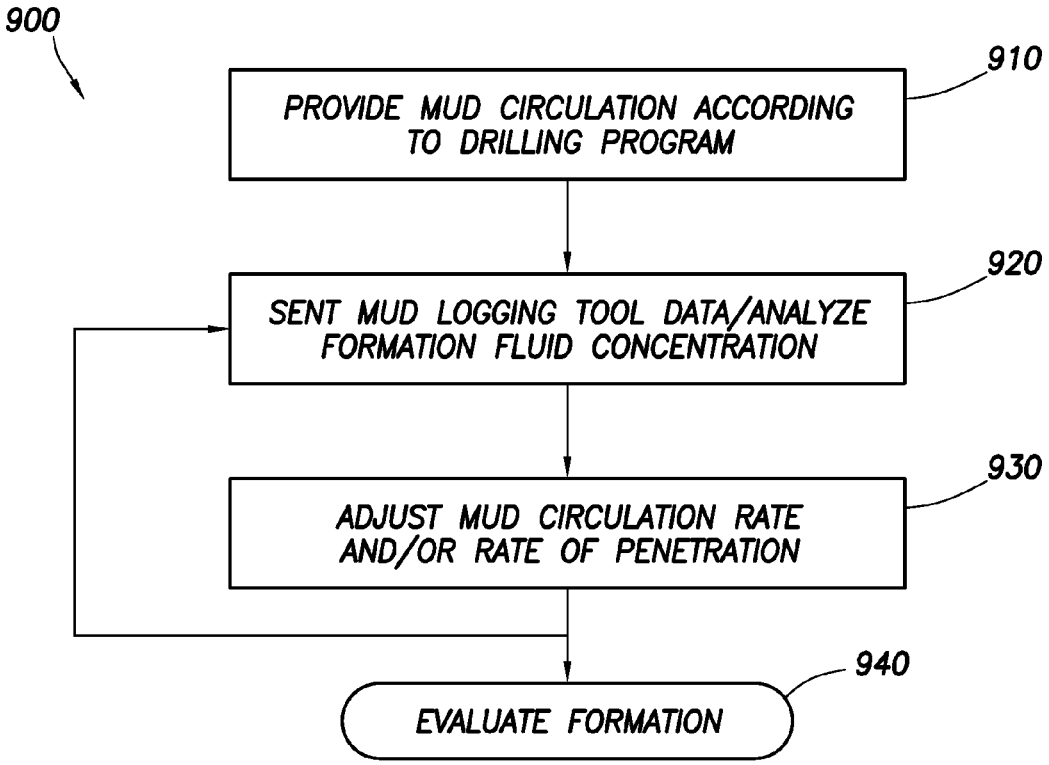
FIG. 8 is a flow-chart diagram of at least a portion of a method according to one or more aspects of the present disclosure.

Referring to FIG. 8 an example method 900 is shown, in which a downhole mud-logging operation is controlled. As the drill bit 15 grinds through a hydrocarbon bearing formation some of the hydrocarbon contained within the drilled rock is liberated into the circulating mud stream and is transported to surface. The amount of hydrocarbon discharged into the mud stream depends, amongst other things, proportionally on the rate-of-penetration (ROP) of the drill bit and inversely on the circulation rate (Q). Other factors, such as formation and mud properties, play a role but are, for the most part, not amenable to ready adjustment by an operator. A second group of factors determining the depth of invasion below the bit and hence the concentration of hydrocarbons in the mud stream consists of the mud filtrate loss rate at the time of drilling—primarily the spurt loss, which is controlled by the formation mobility—and the ROP. Thus, a well may be drilled fast enough to ensure that little or no invasion takes place ahead of the bit for a formation of given mobility. Because of the time lag between a time in which a particular depth is penetrated and a time that the mud carrying that hydrocarbon reaches the surface (in the order of 30 minutes to an hour, or longer), the in situ measurements may facilitate the control of the drilling process and control of the hydrocarbon content in the mud. For example, one objective may be to increase the hydrocarbon content of the mud. A downhole mud logging tool coupled with the real-time capabilities of a wired drill pipe telemetry system or other non-mud flow dependent telemetry systems opens up the possibility of controlling the drilling operation to firstly achieve or improve fluid/formation evaluation.

For example, the method 900 may be performed using a downhole mud logging tool such as recently proposed for example in U.S. Pat. App. Pub. No 2007/0137293, which is hereby incorporated by reference. The downhole mud logging tool may perform downhole hydrocarbon composition measurements within the tool.

At step 910, the mud circulation rate is provided, for example according to the drilling program. At step 920, mud logging data is sent to the surface. The data may be analyzed to estimate the formation fluid concentration in the mud. In particular, a determination of whether the concentration is sufficient for characterizing at least a portion of the formation fluid (e.g., the gaseous portion) is made.

At step 930, the rate the mud circulation rate and/or the rate of penetration may be adjusted, for example to increase the concentration in the mud of entrained hydrocarbons originating from the formation. Note that the proportion of hydrocarbon carried by the circulating mud should change but the downhole composition of the hydrocarbon should remain the same.

Given that the formation properties may, in general, be unknown and may vary substantially from one depth to another any strategy may be enacted in real-time thus, the steps 920 and 930 may be repeated to provide real-time control of the drilling operation. When appropriate rate of penetration and/or mud circulation have been achieved so that the concentration in the mud of entrained hydrocarbons originating from the formation reaches a level above the measurement threshold of the analyzing instrumentation of the mud logging tool, the fluid in the formation being drilled may be evaluated at step 940.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method for controlling drilling fluid rate in a wellbore comprising:

deploying a drill string into the well, the drill string connected to a formation testing or sampling tool;

circulating drilling fluid at a first rate through the drill string;

transmitting a measurement related to the formation testing or sampling tool to a surface processor wherein the measurement relates to a power level of a power supply powering the formation testing or sampling tool; and changing the circulation rate of the drilling fluid to a second rate based on the power level of the formation testing or sampling tool being below a predetermined level, wherein the first rate is at a rate sufficient to conduct mud pulse telemetry, the second rate is higher than the first rate and too high to conduct mud pulse telemetry.

2. The method of claim 1 wherein the surface processor automatically, without human intervention, performs the step of changing the circulation rate of the drilling fluid to the second rate based on the measurement.

3. The method of claim 1 wherein the drilling fluid passes through a turbine to generate power to directly or indirectly power the formation testing or sampling tool.

4. The method of claim 3 wherein the measurement is a power consumption of the formation testing or sampling tool and further wherein the second rate is a minimum rate to power the formation testing or sampling tool.

5. The method of claim 1 wherein the measurement is transmitted to the surface processor via wired drill pipe telemetry comprising a plurality of pipe joints communicatively coupled for transmitting data.

6. A method for controlling drilling fluid rate in a wellbore comprising:

deploying a drill string into the well, the drill string connected to a formation testing or sampling tool;

circulating drilling fluid at a first rate through the drill string;

transmitting a measurement related to the formation testing or sampling tool to a surface processor wherein the measurement relates to an operating temperature of the formation testing or sampling tool; and changing the circulation rate of the drilling fluid to a second rate based on the operating temperature exceeding a predetermined level or is at or near a maximum operating temperature, wherein the first rate is at a rate sufficient to conduct mud pulse telemetry, the second rate is higher than the first rate and too high to conduct mud pulse telemetry.

7. A method for controlling drilling fluid rate in a wellbore comprising:

deploying a drill string into the well, the drill string connected to a formation testing or sampling tool;

circulating drilling fluid at a first rate through the drill string;

obtaining a measurement related to contamination of formation fluid with the formation testing or sampling tool wherein the measurement relates to the contamination level of extracted fluid; and changing the circulation rate of the drilling fluid to a second rate based on the contamination level of extracted fluid being below a predetermined level in order minimize contamination while still permitting the formation testing or sampling tool to have adequate power to obtain the measurement, wherein the first rate is at a rate sufficient to conduct mud pulse telemetry, the second rate is higher than the first rate and too high to conduct mud pulse telemetry.

* * * * *